US006092556A

United States Patent [19]

Adkins

[11] Patent Number: 6,092,556

[45] Date of Patent: Jul. 25, 2000

[54] MULTI-WALL TUBE

[75] Inventor: Delbert L. Adkins, Clinton Township, Mich.

[73] Assignee: Bundy Corporation, Warren, Mich.

[21] Appl. No.: 09/181,627

[22] Filed: Oct. 28, 1998

[51] Int. Cl.[7] ..... F16L 9/14; F16L 11/00

[52] U.S. Cl. ..... 138/142; 138/137

[58] Field of Search ..... 181/207; 427/46; 138/137, 142

[56] References Cited

U.S. PATENT DOCUMENTS

| | | | |
|---|---|---|---|
| 4,028,785 | 6/1977 | Jackson et al. | 138/142 |
| 4,706,713 | 11/1987 | Sadamitsu et al. | 138/137 |
| 4,712,642 | 12/1987 | Lalikos et al. | 181/207 |
| 5,139,814 | 8/1992 | Sugao | 427/46 |
| 5,222,652 | 6/1993 | Gibbs et al. | 138/142 |
| 5,590,691 | 1/1997 | Iorio et al. | 138/146 |

*Primary Examiner*—Andres Kashnikow
*Assistant Examiner*—Davis Hwu
*Attorney, Agent, or Firm*—McEachran, Jambor, Keating, Bock & Kurtz

[57] ABSTRACT

A multi-wall tube and a method for making the multi-wall metal tube. In the process, a preformed tube is used as an inner core. A metal strip, coated with binding metal, is longitudinally wrapped around the core tube. The assemblage is then heated to the brazing temperature of the binding metal whereby all layers become integral to form the finished multi-wall tube.

19 Claims, 2 Drawing Sheets

MULTI-WALL TUBE

BACKGROUND OF THE INVENTION

The present invention relates to a method of making multi-wall metal tube and to the resultant tube. More particularly it relates to multi-wall metal tubing produced in a continuous process from precut metal strip.

U.S. Pat. No. 1,431,368 to Bundy, entitled "Tubing", discloses a multi-wall metal tube formed of metal strip that has been tinned or painted with solder and then longitudinally wrapped around a stationary mandrel to form a multi-wall tube. In the process disclosed, the mandrel is used to support the tube at its inside diameter at a finishing stand. This mandrel assures a tight tube construction and size tolerance control. While the process of the Bundy patent has represented the industry standard for over forty year, an opportunity for improvement has been noted with a resultant tube that is considered at least equal to that currently used. Specifically, the mandrel at the finishing station is a source of continuous concern, and its maintenance a substantial cost factor.

The present invention represents an improvement of the prior art process by elimination of the mandrel. The finished multi-layer tube is also considered new to the art.

SUMMARY OF THE INVENTION

The present invention is directed to a method for making multi-wall metal tube and to the resultant tube. In the process, a preformed tube is used as an inner core. A metal strip, coated with binding metal, is longitudinally wrapped around the core tube. The assemblage is then heated to the brazing temperature of the binding metal whereby all layers become integral to form the finished multi-wall tube.

As compared to processes such as described in U.S. Pat. No. 1,431,368, the total process capability for the present invention is dramatically improved. Size variability, scrap and downtime resulting from the selection, positioning and adjustment of the mandrel are reduced or eliminated. The cleanliness of the interior of the resultant product is also improved since little or no lubricant is required in the forming mold.

DETAILED DESCRIPTION OF THE INVENTION

Figure 1:
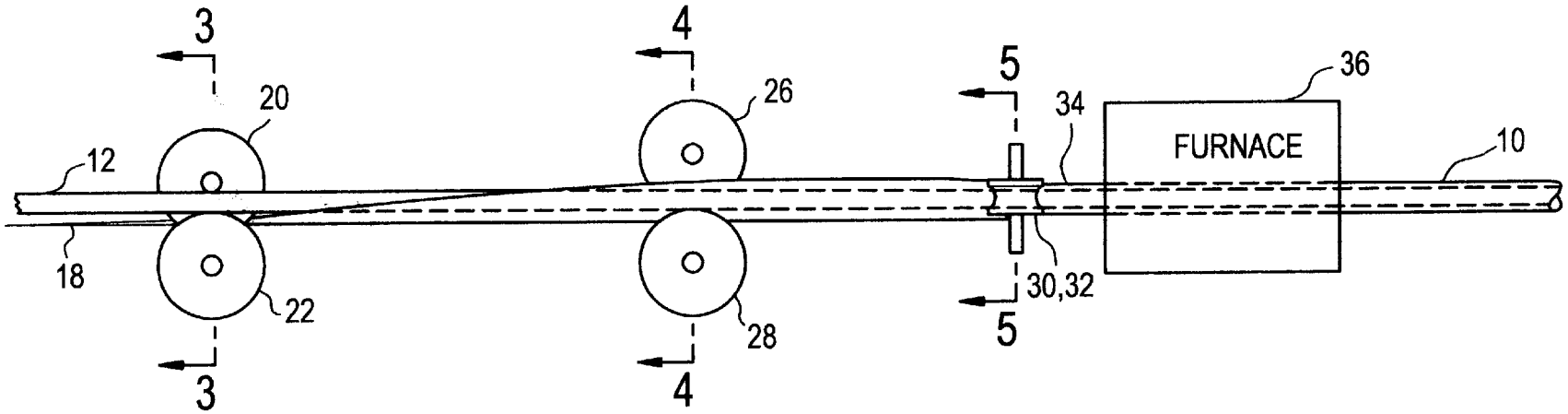
FIG. 1 is a side view showing processing apparatus used to perform the inventive method.

The method of the present invention employs an in-line processing mill as illustrated in FIG. 1. In the process, an inner core tube 12 and a metal strip or wrap coated with binding metals 16 are supplied simultaneously to the in-line processing mill. The coated metal wrap 18 passes through a first set of rollers 20 and 22 which puts a shoulder portion in the coated metal wrap. A second set of rollers 26 and 28 curl the edges of the coated metal wrap up. A third set of rollers 30 and 32 press the coated metal wrap in an overlapping relation around the inner core tube 12. The assemblage 34 of the inner core tube 12 and coated wrap 18 is then fed either continuously, or in batches, into a furnace 36 held at the brazing temperature of the binding metal 16. Brazing causes all layers to become integral.

The multi-wall tube of the present invention is a multi-wall tube 10 comprising an inner core tube 12 and an outer strip or wrap 18 brazed to the inner core tube 12. The inner core tube 12 in itself is pressure tight independent of the outer wrap 18. Due to variability within the manufacturing process, the seam of the outer wrap 18 may be loose or has voids present. Without a pressure tight inner core tube 12 present, the loose outer seam would be a source of leakage.

This concern is even more evident in the formation of a flare at the end of the multi-layer tube. A flare is a radially enlarged flange at the end of a tube for connection with a mating component. A flare is formed by hitting the end of the tube with at least one punch, while the tube is situated in a clamp block. The clamp block and punch are both machined to produce the appropriate flare size and shape. A single flare is formed with one hit by a single punch. A double flare requires two hits by two different punches. To form a double flare, the first hit by the first punch forms a variation of the front bead. The second hit by the second punch folds the tube inwardly and coins the appropriate angle on the flare sealing surface. During the flare forming process, stresses are formed at the end of the flare and the fold section of the double flare. These stress areas have potential for seam separation and creates a source of leakage.

Concerns for leakage through the seam of the metal wrap 18 are eliminated with the use of an inner core tube 12 in which itself is pressure tight. The metal wrap 18, although enhances fatigue resistance and pressure containment, is not critical to leak integrity of the multi-wall tube 10. This assures 100% leak integrity solely to the leak integrity of the inner core tube 12. Hence, the need to scrap the finished tube, due to looseness, separation or void in seam of the metal wrap, is reduced for the present invention.

As noted in the background section, prior to the present invention, a mandrel is necessary to support the outer layer at inside diameter at the finishing stand. The mandrel remains stationary while a continuously moving metal stock is wrapped around the stationary mandrel. Lubrication between the stationary mandrel and the moving metal stock is therefore necessary to reduce the friction between the mandrel and the metal stock. Hence, a by-product of the mandrel process is the remains of the lubrication in the inside diameter of the finished multi-wall tube 10. The use of an inner core tube 12, in place of a mandrel, to support the tube at its inside diameter during the formation of the outer wall layers eliminates the inside diameter cleanliness issue since little, or possibly no, lubricant is required in the process.

Moreover, the inner core tube 12, defining the inside diameter of the multi-wall tube 10, is formed during a separate process from the in-line process mill. The cleanliness of the of inside diameter is then independent of the in-line process mill, but rather is dependent on the formation of the inner core tube 12. As long as inner core tube is formed in such a manner that its inside diameter is clean, the inside diameter of the multi-wall tube 10 would likewise be clean.

The use of an inner core tube 12 in place of a mandrel also eliminates the downtime required for changing the mandrel. Although in the prior process lubricants are used between the mandrel and the metal stock to reduce friction, wear on the mandrel still occurs. Once wear reduces the diameter of the mandrel, the inside diameter of the tube is also reduced. As a result, the difference between the inside diameter and the outer diameter is increased allowing the seam to have voids or looseness. Since voids or looseness in the seams are highly undesirable, the mandrel would need to be changed on a periodic basis creating downtime in the process. The present invention does not use a stationary mandrel, rather, an inner core is fed at the same rate as the metal stock for forming the outer layer. Hence, downtimes for changing worn mandrels are eliminated.

Another advantage of using an inner core tube in place of a mandrel is the elimination of the step of applying a carbon lacquer on the assemblage prior to the heating stage. If the resultant tube were not supported on either side, upon heating the assemblage to the brazing temperature of the binding metal, the binding metal would run off from the seam and the assemblage would have a tendency to unwrap. To prevent the binding metal from running off, a carbon lacquer is applied to the assemblage prior to the heating process. The carbon lacquer has a similar effect as oxidizing the binding metal and solidifies the binding metal. In addition, due to the dark color of the carbon lacquer, it also creates a black body effect allowing the resultant tube to absorb heat more quickly and evenly.

A tube having a permanent inner core tube, in place of a mandrel for forming the outer tube, would eliminate the problems associated with the tube unwrapping and the need for the black body effect. The metal wrap 18 is supported at the inside diameter by the inner tube 12; hence, the tendency for the metal wrap 18 to unwrap during the heating stage is reduced. In addition a process using an inner tube does not need to absorb as much heat since the process is more forgiving due the metal wrap 18 supported at the inner diameter by the inner core tube 12. With the temperature for the heating process lower for the present invention than for a process without an inner core tube, the temperature in the furnace would not be high enough to cause the binding metal 12 to run off.

Suitable tubes to form inner core tube 12 include single wall welded steel tube, single wall welded stainless steel tube, single wall seamless steel tube, single wall seamless stainless steel tube, brazed double wall tube or multi-wall tube of various constructs described herein. The inner core tube 12 may be produced by conventional tube forming method. The particular process used for forming the inner core tube 12 is not a part of this invention. The formed inner core 12 can be fed to the outer wall tube forming mill in a continuous integrated line immediately after the formation of the inner core tube. Alternatively, the formed inner core tube 12 can be accumulated in a coiled form and then later fed to the outer layer forming mill.

Figure 5:
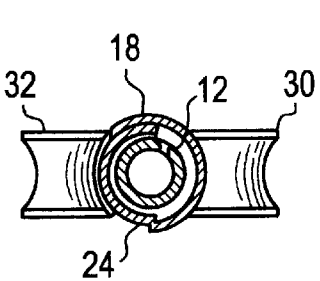
FIG. 5 is a sectional view on the line 5—5 of FIG. 1 showing the stock passing through the final set of forming rolls.
Figure 4:
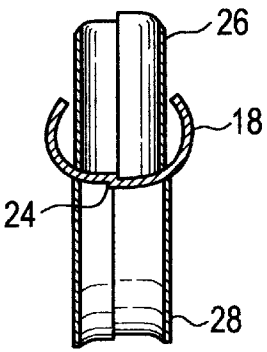
FIG. 4 is a sectional view on the line 4—4 of FIG. 1 showing the stock passing through the second set of forming rolls.
Figure 3:
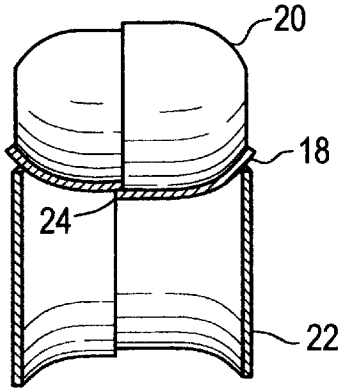
FIG. 3 is a sectional view on the line 3—3 of FIG. 1 showing the stock passing through the first set of forming rolls.
Figure 2:
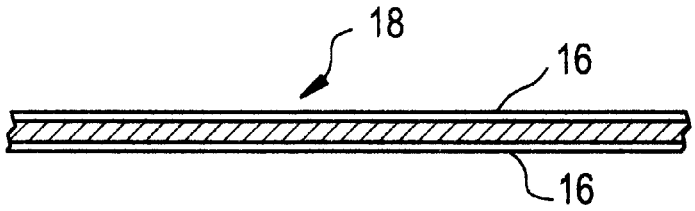
FIG. 2 is an enlarged sectional view showing in an enlarged scale the stock coated with binding metal before it passes into the dies.

A side view of the forming mill is shown on FIG. 1. Metal strip or wrap 18 is shown in FIG. 2. It is cut to appropriate width and coated with a binding metal 16 on both sides. Suitable binding metals 16 include copper, nickel, silver braze alloy or any combinations of these metals. The metal wrap 18, coated with binding metal 16, is fed continuously to the in-line processing mill at the same rate as the inner core tube 12 is being fed to the in-line processing mill. At the in-line processing mill, metal wrap 18 passes between the upper roll 20 and lower roll 22 which puts a shoulder portion 24 in the metal stock as shown on FIG. 3. Shoulder 24 is offset to one side of the center of the metal wrap 18 such that one side of the wrap is wider than the other side. This allows the wider side to curl over the narrower portion of the wrap. Thereafter, the metal wrap 18 reaches rolls 26 and 28 which serve to curl the edges of the metal wrap up as shown on FIG. 4. The metal wrap 18 then passes around the core tube 12 and a set of horizontally-disposed pressure rolls 30 and 32 serve to press the metal wrap 18 in overlapped relation around the core tube 12 as shown on FIG. 5.

The assemblage 34, comprising the inner core tube 12 longitudinally wrapped with metal wrap 18, is then fed continuously into in a furnace 36 to the brazing temperature of the binding metal 16, whereby all layers become integral to complete the multi-wall product of the present invention. Again, the details of the brazing process are conventional and well known.

Alternatively, the assemblage 34 can be batch processed by cutting it into 60 to 100 feet length sections after the metal wrap 18 is wrapped around the core tube 12. The cut sections of the assemblage 34 are then batch heated in a furnace to the brazing temperature of the binding metal 16.

Figure 6:
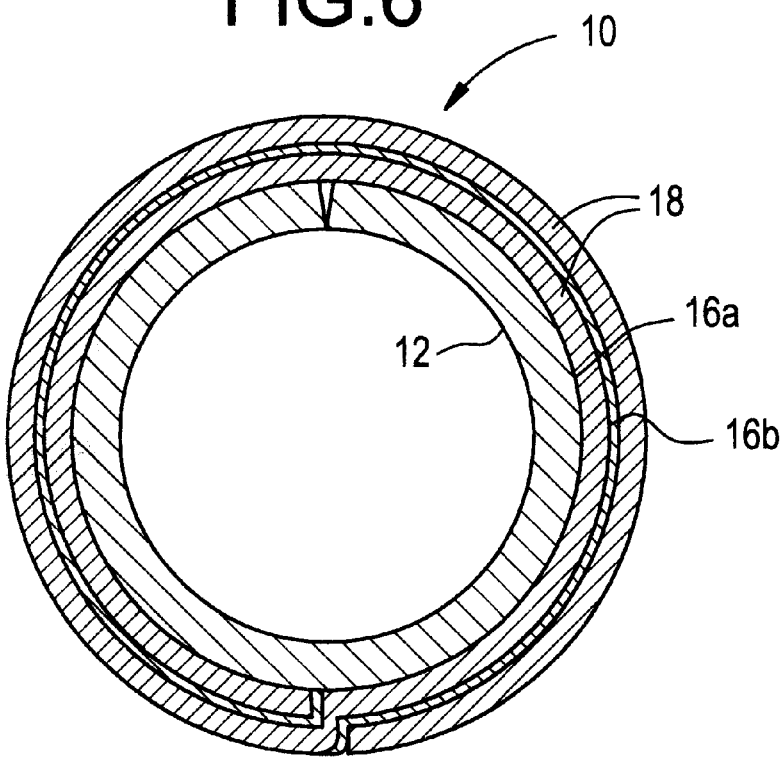
FIG. 6 is a cross section through the finished tube.

A cross-section view of the finished multi-layer tube product 10 is shown in FIG. 6. The multi-layer tube 10 comprises an inner core tube 12, a metal wrap 18 wrapped around the inner tube 12 and a binding layer 16*a* between the inner core 12 and the metal wrap 18. Located between the metal wrap 18 is another binding metal layer 16*b*. The tube differs from prior tubes because it has extra layers construction. Alternatively, the strip could be narrower and only wrapped around once or the strip can be wider and wrapped around three times.

Yet another variation of the present invention comprise using a double-wall tube as the core material rather than a single wall tube. As stated earlier, the inner core tube 12 is pressure tight and the metal wrap 18 is not critical to the leak integrity of the multi-walled tube 10. Thus, for the multi-wall tube 10 to function effectively for high pressure applications, such as diesel tube, a double-wall tube is used in place of a single wall tube as the core tube.

Various features of the present invention have been described with reference to one embodiment. It should be understood that modification may be made without departing from the spirit and scope of the present invention as represented by the following claims. For instance, the above embodiment is for the formation of metal strip 18 having two layers. Depending on the amount fatigue resistance and pressure containment required by the resultant tube, the metal strip 18 can be formed of a single layer or the metal strip 18 can be formed of three or more layers.

What is claimed is:

1. A multi-layer metal tube comprising:

an inner core tube having an outer cylindrical surface;

a continuous strip of metal having an inner cylindrical surface coated with brazing material;

wherein said metal strip is longitudinally wrapped at least once around said core tube and brazed thereto to form an integral tube.

2. A multi-layer metal tube according to claim 1 wherein the brazing material connects at least the inner surface of said strip to said outer cylindrical surface of said inner core tube.

3. A multi-layer tube as claimed in claim 1 wherein said metal strip is longitudinally wrapped twice around said core tube.

4. A multi-layer tube as claimed in claim 1 wherein said metal strip is longitudinally wrapped three times around said core tube.

5. A multi-layer tube as claimed in claim 1 wherein said inner core tube has pressure tight integrity.

6. A multi-layer tube as claimed in claim 5 wherein said core tube is selected from a group consisting of single wall welded steel tube, single wall welded stainless steel tube, single wall seamless steel tube, single wall seamless stainless steel tube, brazed double wall tube or multi-wall tube.

7. A multi-layer tube as claimed in claim 1 wherein said brazing material is selected from a group consisting of copper, nickel, silver braze alloy or any combinations of these.

8. A multi-layer tube comprised of:

an inner core tube;

a continuous metal strip longitudinally wrapped around said inner core tube;

a layer of binding metal between said inner core tube and said wrapped metal strip binding said wrapped metal strip to said inner core tube.

9. A multi-layer tube as claimed in claim 8 wherein said metal strip overlaps itself at least once.

10. A multi-layer tube as claimed in claim 8 wherein said metal strip overlaps itself at least twice.

11. A multi-layer tube as claimed in claim 8 wherein said inner core tube has pressure tight integrity.

12. A multi-layer tube as claimed in claim 11 wherein said core tube is selected from a group consisting of single wall welded steel tube, single wall welded stainless steel tube, single wall seamless steel tube, single wall seamless stainless steel tube, brazed double wall tube or multi-wall tube.

13. A multi-layer tube as claimed in claim 8 wherein said binding metal is selected from a group consisting of copper, nickel, silver braze alloy or any combinations of these.

14. A method of manufacturing a multi-layer tube comprising the steps of:

(a) providing an inner core tube;

(b) providing a continuous metal strip coated on at least one side with binding metal suitable for brazing;

(c) wrapping said metal strip at least once longitudinally around said core tube;

(d) heating said inner core tube wrapped with said metal strip to brazing temperature of said binding metal whereby all layers would become integral.

15. A method of manufacturing a multi-layer tube as claimed in claim 14 wherein said core tube has pressure tight integrity.

16. A method of manufacturing a multi-layer tube as claimed in claim 15 wherein said core tube is selected from a group consisting of single wall welded steel tube, single wall welded stainless steel tube, single wall seamless steel tube, single wall seamless stainless steel tube, brazed double wall tube or multi-wall tube.

17. A method of manufacturing a multi-layer tube as claimed in claim 14 wherein said binding material is selected from a group consisting of copper, nickel, silver braze alloy or any combinations of these.

18. A method of manufacturing a multi-layer tube as claimed in claim 14 wherein said metal strip is longitudinally wrapped twice around said core tube.

19. A method of manufacturing a multi-layer tube as claimed in claim 14 wherein said metal strip is longitudinally wrapped three times around said core tube.

* * * * *